US006595399B1

(12) United States Patent
Cassese

(10) Patent No.: US 6,595,399 B1
(45) Date of Patent: Jul. 22, 2003

(54) STAPLE-DRIVER-MAGAZINE FOR MANUAL FRAME STAPLER

(75) Inventor: Alain Cassese, Mormant (FR)

(73) Assignee: Societe Cassese, Verneuil l'Etang (FR)

( * ) Notice: Subject to any disclaimer, the term of this patent is extended or adjusted under 35 U.S.C. 154(b) by 0 days.

(21) Appl. No.: 09/623,504

(22) PCT Filed: Mar. 22, 1999

(86) PCT No.: PCT/FR99/00662

§ 371 (c)(1),
(2), (4) Date: Nov. 30, 2000

(87) PCT Pub. No.: WO99/48649

PCT Pub. Date: Sep. 30, 1999

(30) Foreign Application Priority Data

Mar. 26, 1998 (FR) ..... 98 03733

(51) Int. Cl.[7] ..... B25C 5/02
(52) U.S. Cl. ..... 227/120; 227/136; 227/113
(58) Field of Search ..... 227/120, 136, 227/113, 147; 29/243.56

(56) References Cited

U.S. PATENT DOCUMENTS

| | | | | | |
|---|---|---|---|---|---|
| 3,693,863 | A | * | 9/1972 | Black | 227/127 |
| 4,353,157 | A | * | 10/1982 | Sato | 29/243.56 |
| 4,378,065 | A | | 3/1983 | Smirne | |
| 4,830,257 | A | | 5/1989 | Lin | |
| 4,996,755 | A | * | 3/1991 | Sato | 29/243.56 |
| 5,119,553 | A | * | 6/1992 | Sato | 24/67.9 |
| 5,136,768 | A | * | 8/1992 | Sato | 227/156 |
| 5,152,423 | A | * | 10/1992 | Tseng | 221/279 |
| 5,244,139 | A | * | 9/1993 | Joyce | 206/340 |
| 5,390,842 | A | * | 2/1995 | Joyce | 227/110 |
| 5,673,838 | A | * | 10/1997 | Reitze | 227/119 |
| D386,526 | S | * | 11/1997 | Ito | D19/48 |
| 5,758,812 | A | * | 6/1998 | Raffoni | 227/120 |
| 5,890,642 | A | * | 4/1999 | Sato | 227/120 |
| 6,220,121 | B1 | * | 4/2001 | Leete | 81/44 |

FOREIGN PATENT DOCUMENTS

| | | |
|---|---|---|
| DE | 93 06 388 U | 9/1993 |
| EP | 0 521 724 A | 1/1993 |
| FR | 2 747 604 A | 10/1997 |

* cited by examiner

*Primary Examiner*—Rinaldi I. Rada
*Assistant Examiner*—Louis Tran
(74) *Attorney, Agent, or Firm*—Arent Fox Kintner Plotkin & Kahn

(57) ABSTRACT

A stable pushing magazine for a manual frame stapler having a punch bearing a guide member in the form of a stud magnetized to hold a staple positioned against it. The magazine is in the form of an elongated, closed drawer. One face of the magazine is pierced by a longitudinal opening and another end of the magazine opens in a window at the end of the drawer. The drawer contains a sliding pusher operated by a button for the purpose of displacing the contiguous staples and of placing one staple on the punch via the window at the end of the drawer.

5 Claims, 3 Drawing Sheets

STAPLE-DRIVER-MAGAZINE FOR MANUAL FRAME STAPLER

BACKGROUND OF THE INVENTION

The invention relates to framing and more especially concerns a magazine suitable for pushing staples and positioning them one by one on a manual stapler.

There exist staplers that are simple to handle and that enable the user to put profiled staples in place manually in chamfers or beadings for frames.

In one known apparatus, the surface of the punch used to cause the staple to penetrate the wood is provided with a guide member in the form of a stud, which is usually cylindrical and which is magnetised and can thus hold a staple in position against it until the tool is presented in the right place on the beading prior to driving in the staple. The latter, which advantageously has a V profile, therefore has to be put in place on the stapler, the right way round, that is to say with the sharpened portion facing outwards, and it is quite clear that none of the staple loaders, such as those described, for example, in documents FR 2747604, EB 0521724 or U.S. Pat. No. 4,738,065, and which are designed for distribution to an automatic stapling machine, can be suitable for supplying this hand tool.

BRIEF SUMMARY OF THE INVENTION

The invention solves this problem by providing a staple pushing magazine for a manual frame stapler having a punch bearing a guide member in the form of a stud magnetised to hold a staple positioned against it, said magazine being in the form of an elongate, closed drawer, one face of which is pierced by a longitudinal opening and one end of which opens in a window at the end of the drawer, said drawer containing a sliding pusher operated by a button for the purpose of displacing the contiguous staples and of placing one staple on the punch via the window at the end of the drawer . A device for elastically retaining the pusher sliding through the drawer is constituted by at least one tab provided at the height of at least one toothed rail extending parallel to the face of the magazine for feeding the staples stepwise.

According to the constructional characteristics of the invention, the window is rectangular and framed by vertical edges forming a guide for the lateral wings of a staple, whereas the pusher bears a profiled head having two edges with a triangular cross-section having a profile corresponding to that of a staple and its lateral wings. The button is mounted on spacers sliding through a longitudinal opening in the magazine, which spacers fasten on to ribs provided on either side of the central body of the pusher.

According to another particular characteristic of the invention, the tabs of the device for elastically retaining the sliding pusher are provided on either side of the head of the pusher, and at the height of toothed rails which extend over the lateral sides of the magazine, the tabs being equipped with tips that co-operate with spaces located between teeth provided on the toothed rails.

Advantageously, the teeth are delimited by a front face, in the direction of the window of the magazine, perpendicular to the sides of the magazine, and, on the other side, by a rear face inclined at an angle of approximately 45°.

Conversely, the tips are delimited forwards by an inclined face, and rearwards by a face perpendicular to the central body of the pusher.

Further particular characteristics and advantages of the invention will emerge from the description that follows of a form of embodiment, in which reference is made to the annexed drawings, wherein:

DETAILED DESCRIPTION OF THE INVENTION

Figure 1:
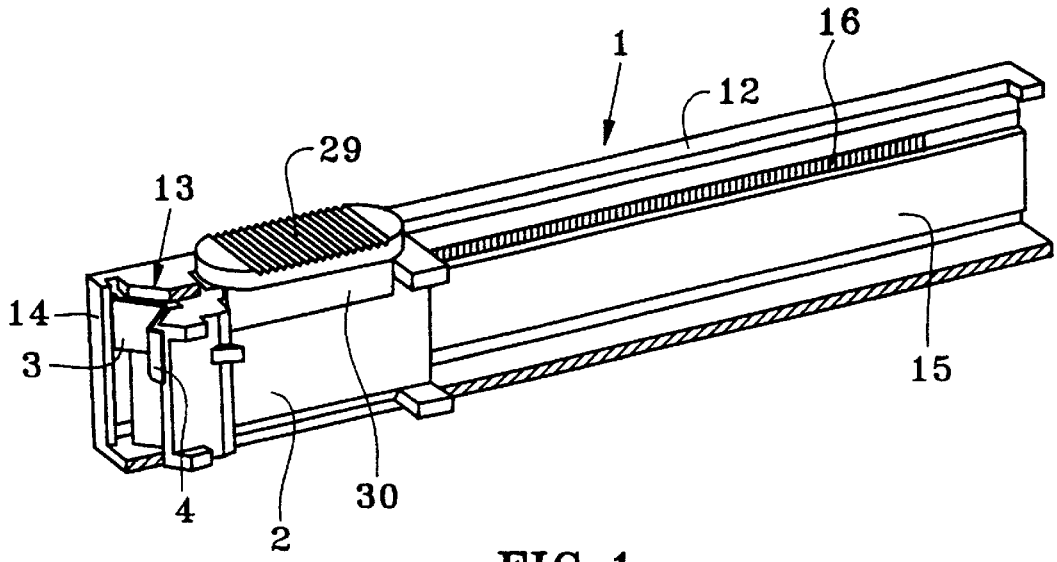
FIG. 1 is a perspective view, with parts stripped away, of the staple pushing magazine.

FIG. 1 shows a staple pushing magazine, generally designated by reference number 1, through which moves a sliding pusher, generally designated by reference number 2.

Figure 2:
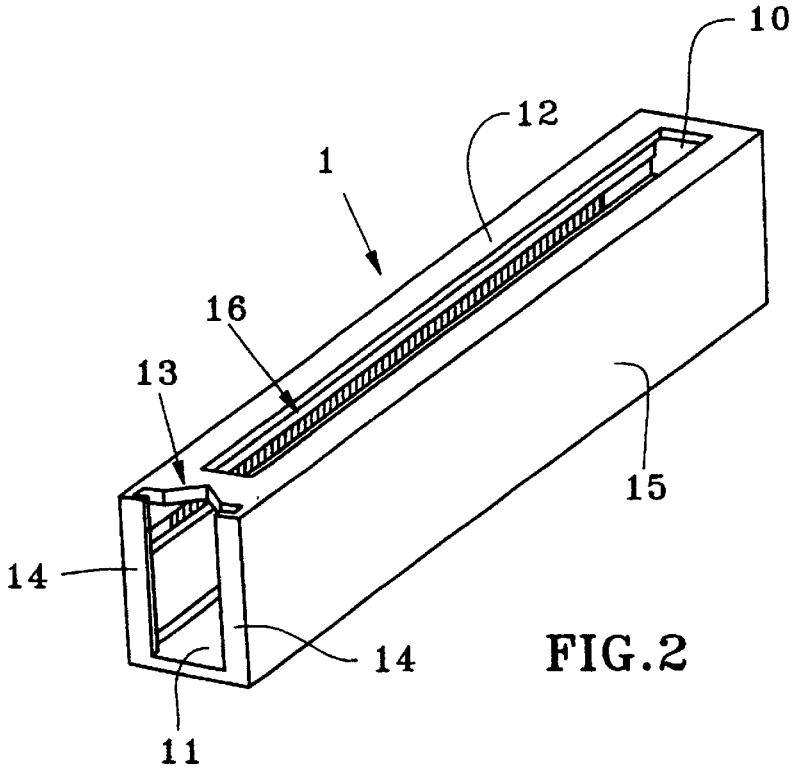
FIG. 2 is a perspective view of the drawer forming the magazine.

With reference likewise to FIG. 2, it can be seen that magazine 1 takes the form of an elongate, closed drawer one face, 12, of which is pierced by a longitudinal opening 10, and one end (to the front in FIG. 2) of which opens in a rectangular window 11, at the end of the drawer. Between opening 10 and window 11, face 12 has a V-shaped cut-out portion 13, the profile of which matches the profile of a staple 3. This cut-out portion is located on the side on which the staple leaves the magazine, above window 11. The window is framed by two vertical edges 14 which form a guide for the lateral wings 4 of staple 3, as more clearly apparent in FIG. 1. The thickness of this guide, that is to say the distance between the vertical edge 14 and the part of cut-out portion 13 that is located opposite it, substantially matches the thickness of a staple. Thus, it is not possible for two contiguous staples to exit simultaneously from the magazine.

The two lateral sides 15 of the magazine are internally provided with toothed rails 16 extending parallel to face 12 over the entire length of the magazine. According to one alternative embodiment, not shown, the toothed rails are provided a little higher than those to be seen in FIGS. 1 and 2, more precisely on the longitudinal borders of opening 10, in the area of face 12.

Figure 3:
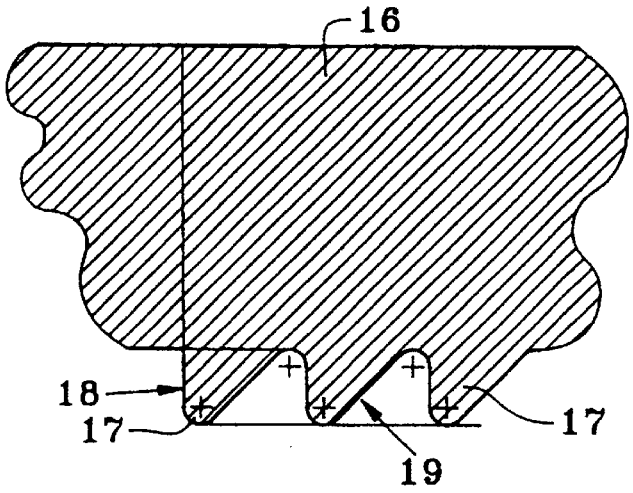
FIG. 3 is a larger scale cross-sectional partial view of a toothed rail.

FIG. 3 shows the shape of the toothing of the rails, constituted by a succession of teeth 17 delimited, on one side, by a front face 18, in the direction of window 11, which is perpendicular to the plane of sides 15 of the magazine and, on the other side, by a rear face 19 inclined rearwards at an angle of approximately 45°.

Figure 4:
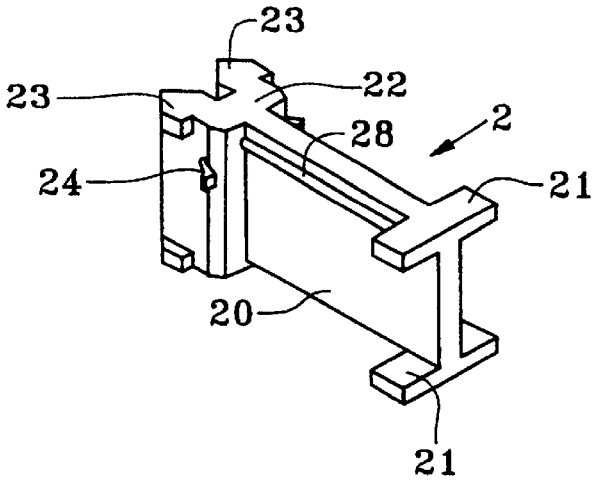
FIGS. 4 and 5 are perspective and top views, respectively, of the pusher.
Figure 5:
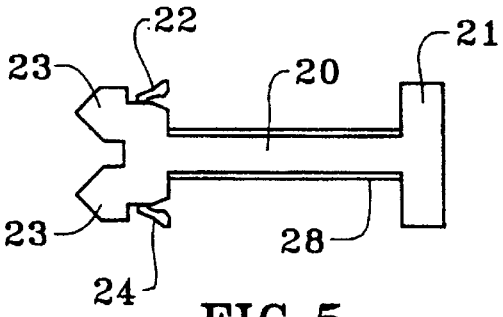
Figure 6:
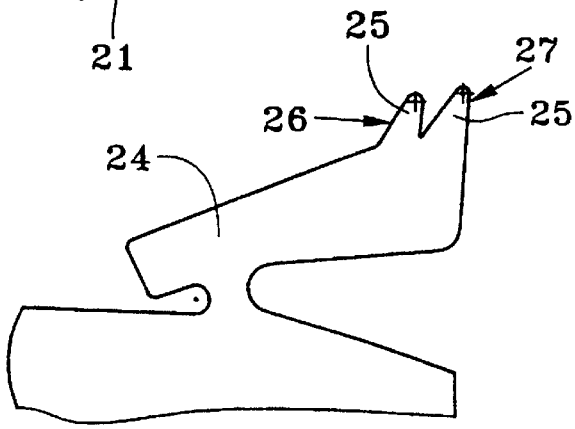
FIG. 6 is a larger scale cross-sectional view of a tab of the pusher.

Pusher 2, also shown in FIGS. 4 and 5, is constituted by a central body 20, bearing at the rear, that is to say on the side away from window 11, two guide fins 21 bearing upon sides 15 of the magazine. On the front side, the central body has a profiled head 22 with two vertical edges 23 of triangular cross-section having a profile matching that of a staple 3 and of its lateral wings 4. On either side of head 22 is mounted, in the area of the toothed rail 16 of the magazine, a tab 24 equipped with two tips 25, more clearly visible in FIG. 6. By contrast with teeth 17 of the toothed rail, tips 25 are delimited forwards by an inclined face 26, and rearwards by a face 27 perpendicular to the central body 20 of the pusher. Tabs 24 co-operate with the spaces located between the teeth 17 of the toothed rails and thus constitute a device for elastically retaining the pusher sliding through the drawer, to ensure the step by step feed of the staples. The distance between the ends of two successive teeth is designed to be greater than the thickness of a staple.

Finally, it will be noted that, on either side of the central body, there is provided a rib 28 serving to fasten the operating button 29 that can be seen in FIG. 1. This button 29, with its corrugated face, is mounted on two spacers 30 by means of which it is fastened on to ribs 28 of the pusher, the spacers possessing a certain elasticity and being provided with a groove for the purpose of snap fitting them onto said ribs. The button makes it possible to cause the pusher to slide easily inside the magazine, with its wings 30 moving through opening 10 in the drawer, the edges of which serve to guide it.

Figure 7:
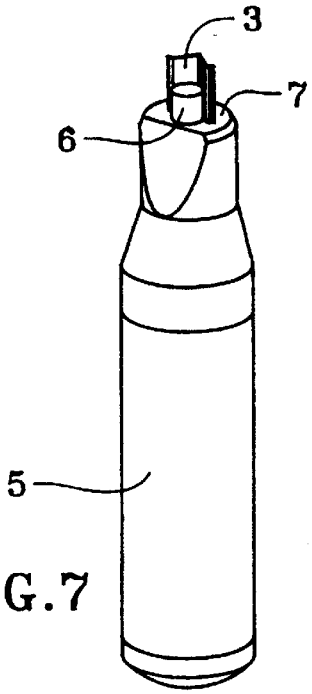
FIG. 7 is a perspective view of a hand stapler.

The magazine thus described can be used for putting staples into place on a hand stapler 5, shown in FIG. 7. The procedure consists, in fact, in placing a staple 3 against a magnetised stud 6 projecting from a plane surface 7, in such a way that the staple is held on the tool, as shown, with the bevelled portion upwards.

Figure 8:
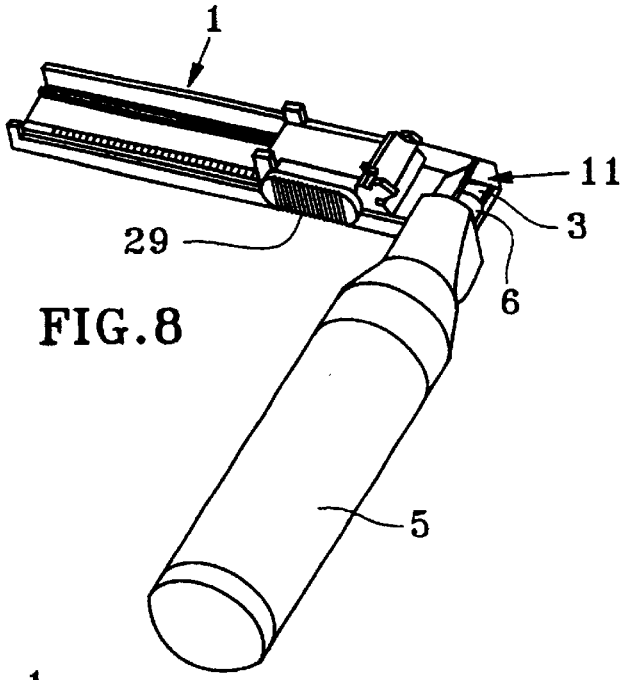
FIGS. 8 and 9 are perspective views of the magazine and of the hand stapler in staple presenting and magazine withdrawal positions, respectively.
Figure 9:
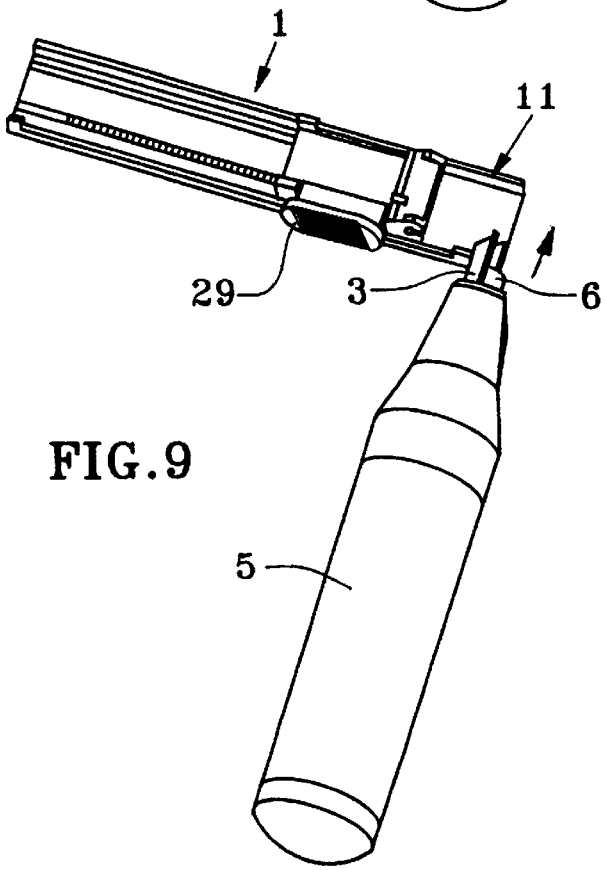

The staples, which are contiguous, but not joined to one another, are disposed in the magazine, with their sharpened portions located at the bottom, on the side away from button 29. It can be seen from FIG. 8 that magazine 1 is placed against the stapler in such a way that the first staple appearing in window 11 is pressed against stud 6, perpendicularly to surface 7. The user then moves the magazine upwards, in the direction of the arrow, as indicated in FIG. 9, and the staple remains in position on the tool.

By means of button 29, the bunch of staples is fed in the direction of the opening in the magazine, with the staples being fed stepwise thanks to the elastic tabs 24, which escape from teeth 17 of the corresponding toothed rail 16, after which they fit against the following tooth. As a slight clearance is provided between a staple and the two teeth 17 that frame it, since the latter are spaced by a distance greater than the thickness of the staple, this facilitates the exit of the staples from the magazine each time the pusher advances. A lubricant can be applied, if needed, to the rails and the magazine to facilitate the movement of the staples.

What is claimed is:

1. A staple pushing magazine for a manual frame stapler having a punch bearing a guide member in the form of a stud magnetized to hold a staple position against it, wherein the magazine is in the form of an elongated, closed drawer, one face of which is pierced by a longitudinal opening and one end of which opens in a window at the end of the drawer, in that said drawer includes a sliding pusher operated by a button for the purpose of displacing the contiguous staples and for placing one staple on the punch via the window at the end of the drawer, and a device for elastically retaining the pusher sliding through the drawer comprising at least one tab provided at the height of at least one toothed rail extending parallel to the face of the magazine, for feeding the staples stepwise, wherein the button is mounted on spacers sliding through the longitudinal opening in the magazine, which spacers fasten onto ribs provided on either side of the central body of the pusher.

2. A staple pushing magazine for a manual frame stapler having a punch bearing a guide member in the form of a stud magnetized to hold a staple position against it, wherein the magazine is in the form of an elongated, closed drawer, one face of which is pierced by a longitudinal opening and one end of which opens in a window at the end of the drawer, in that said drawer includes a sliding pusher operated by a button for the purpose of displacing the contiguous staples and for placing one staple on the punch via the window at the end of the drawer, and a device for elastically retaining the pusher sliding through the drawer comprising at least one tab provided at the height of at least one toothed rail extending parallel to the face of the magazine, for feeding the staples stepwise, wherein the pusher bears a profiled head having two edges of a triangular cross-section with a profile corresponding to that of a staple and of its lateral wings, and wherein the tab is equipped with tips co-operating with spaces located between teeth provided on the tooth rails.

3. A staple pushing magazine for a manual frame stapler having a punch bearing a guide member in the form of a stud magnetized to hold a staple position against it, wherein the magazine is in the form of an elongated, closed drawer, one face of which is pierced by a longitudinal opening and one end of which opens in a window at the end of the drawer, in that said drawer includes a sliding pusher operated by a button for the purpose of displacing the contiguous staples and for placing one staple on the punch via the window at the end of the drawer, and a device for elastically retaining the pusher sliding through the drawer comprising at least one tab provided at the height of at least one toothed rail extending parallel to the face of the magazine, for feeding the staples stepwise, wherein the window is rectangular and framed by vertical edges forming a guide for lateral wings of a staple, and wherein the teeth are delimited by a front face, in the direction of the window of the magazine, perpendicular to the sides of the magazine and, on the other side, by a rear face inclined at an angle of approximately 45°.

4. A staple pushing magazine for a manual frame stapler having a punch bearing a guide member in the form of a stud magnetized to hold a staple position against it, wherein the magazine is in the form of an elongated, closed drawer, one face of which is pierced by a longitudinal opening and one end of which opens in a window at the end of the drawer, in that said drawer includes a sliding pusher operated by a button for the purpose of displacing the contiguous staples and for placing one staple on the punch via the window at the end of the drawer, and a device for elastically retaining the pusher sliding through the drawer comprising at least one tab provided at the height of at least one toothed rail extending parallel to the face of the magazine, for feeding the staples stepwise, wherein the window is rectangular and framed by vertical edges forming a guide for lateral wings of a staple, and wherein the distance between the ends of two successive teeth is greater than the thickness of a staple.

5. A staple pushing magazine for a manual frame stapler having a punch bearing a guide member in the form of a stud magnetized to hold a staple position against it, wherein the magazine is in the form of an elongated, closed drawer, one face of which is pierced by a longitudinal opening and one end of which opens in a window at the end of the drawer, in that said drawer includes a sliding pusher operated by a button for the purpose of displacing the contiguous staples and for placing one staple on the punch via the window at the end of the drawer, and a device for elastically retaining the pusher sliding through the drawer comprising at least one tab provided at the height of at least one toothed rail extending parallel to the face of the magazine, for feeding the staples stepwise, wherein the pusher bears a profiled head having two edges of a triangular cross-section with a profile corresponding to that of a staple and of its lateral wings, and wherein the tips are delimited forwards by an inclined face, and rearwards by a face perpendicular to the central body of the pusher.

* * * * *